US012638276B2

(12) United States Patent
Shelton

(10) Patent No.: US 12,638,276 B2
(45) Date of Patent: May 26, 2026

(54) ARMING TANDEM AND LOCKING COLLAR FOR PERFORATING GUN SYSTEMS

(71) Applicant: HARRISON JET GUNS II, L.P., Kennedale, TX (US)

(72) Inventor: James F. Shelton, Kennedale, TX (US)

(73) Assignee: Harrison Jet Guns II, L.P., Kennedale, TX (US)

( * ) Notice: Subject to any disclaimer, the term of this patent is extended or adjusted under 35 U.S.C. 154(b) by 93 days.

(21) Appl. No.: 18/383,229

(22) Filed: Oct. 24, 2023

(65) Prior Publication Data

US 2024/0142203 A1 May 2, 2024

Related U.S. Application Data

(60) Provisional application No. 63/420,901, filed on Oct. 31, 2022.

(51) Int. Cl.

| | |
|---|---|
| ***E21B 43/116*** | (2006.01) |
| ***F42B 1/02*** | (2006.01) |
| ***F42B 3/06*** | (2006.01) |

(52) U.S. Cl.

CPC ..... *F42B 3/06* (2013.01); *E21B 43/116* (2013.01); *F42B 1/02* (2013.01)

(58) Field of Classification Search

CPC ..... E21B 43/116; F42B 1/02

See application file for complete search history.

(56) References Cited

U.S. PATENT DOCUMENTS

2020/0284126 A1* 9/2020 Mauldin ..... E21B 43/117

* cited by examiner

*Primary Examiner* — Tara Schimpf
*Assistant Examiner* — Lamia Quaim
(74) *Attorney, Agent, or Firm* — WARNER NORCROSS + JUDD LLP

(57) ABSTRACT

An arming tandem for a perforating gun is provided. The arming tandem includes an internal arming pin that is biased in a retracted position. Detonating the last perforating gun in a gun string forces the arming pin in the immediately adjacent tandem into contact with a grounding plate in the next perforating gun, thereby arming the next perforating gun. The arming pin is biased in the retracted position by a helical compression spring that is contained within a counterbored opening in the arming tandem. An adjacent bulkhead includes a grounding plate that surrounds a contact pin. The grounding plate provides a flat surface for contacting the arming pin and creating a secure connection to ground.

14 Claims, 6 Drawing Sheets

ARMING TANDEM AND LOCKING COLLAR FOR PERFORATING GUN SYSTEMS

CROSS-REFERENCE TO RELATED APPLICATIONS

This application claims the benefit of U.S. Provisional Application 63/420,901, filed Oct. 31, 2022, the disclosure of which is hereby incorporated by reference.

TECHNICAL FIELD

The present invention relates to perforating gun systems having penetrating shaped charges to generate perforations through a wellbore casing.

BACKGROUND

In oil and gas operations, it is a known practice to install a well casing into a borehole that has been drilled into a geologic formation. A gun string is then lowered into the wellbore on a wireline, slickline or coiled tubing, opposite a hydrocarbon formation. The gun string includes shaped charges that, when fired, are formed into high-velocity jets that penetrate through the wellbore casing. The resulting perforations allow a fluid (oil or gas) to flow into the wellbore.

A gun string will typically include multiple perforating guns, each with opposing box ends having female threads. Tandems having male threads are threaded to one or both ends of each perforating gun in the gun string. In this fashion, multiple perforating guns can be connected end-to-end and sequentially detonated within the wellbore via an electrical signal sent from the surface.

The internal shaped charges are typically detonated by a detonating cord, which in turn is ballistically connected to a detonator that typically is triggered by an addressable switch, which is electronically actuated from the surface. The detonating cord is coupled to the apex of each shaped charge. In this arrangement, a single detonator at one end of the perforating gun will detonate all of the shaped charges in the perforating gun.

Despite their widespread acceptance for wellbore operations, there remains a continued need for improved perforating gun systems. In particular, there remains a continued need for improved perforating gun systems that selectively arm each gun in a gun string and requires less time to be loaded and armed at the wellsite.

SUMMARY OF THE INVENTION

In one embodiment, an arming tandem is provided. The arming tandem includes an internal arming pin that is biased in a retracted position. Detonating the last perforating gun in a gun string forces the arming pin in the immediately adjacent arming tandem into contact with a grounding plate in the next perforating gun, thereby arming the next perforating gun. In this respect, each perforating gun in a gun string can be sequentially armed, optionally without the need for an addressable switch in each such perforating gun. As explained herein in greater detail, the arming pin is biased in the retracted position by a helical compression spring that is contained within a counterbored opening in the arming tandem. An adjacent bulkhead includes a grounding plate that surrounds a contact pin. The grounding plate provides a flat surface for contacting the arming pin and creating a secure connection to ground upon detonation of the up-string perforating gun.

In another embodiment, a locking collar is provided. The locking collar is adapted to secure a perforating gun so that its shaped charges are locked into a set firing position. The locking collar includes upper and lower axial surfaces that are joined by an inner sidewall and an outer sidewall. The inner sidewall is cylindrical, and the outer sidewall is sloped along a major section of its length. The outer sidewall includes a plurality of threaded openings that extend at an angle toward the lower axial surface. Each threaded opening extends entirely through the locking collar at an angle relative to the lower axial surface. In use, the locking collar extends around a top sub and receives set screws within each of the internally threaded openings. The set screws engage a perforating gun to radially align the gun ports of the perforating gun and are more reliable than conventional locking nuts.

These and other features and advantages of the present invention will become apparent from the following description of the invention, when viewed in accordance with the accompanying drawings and appended claims.

Before embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
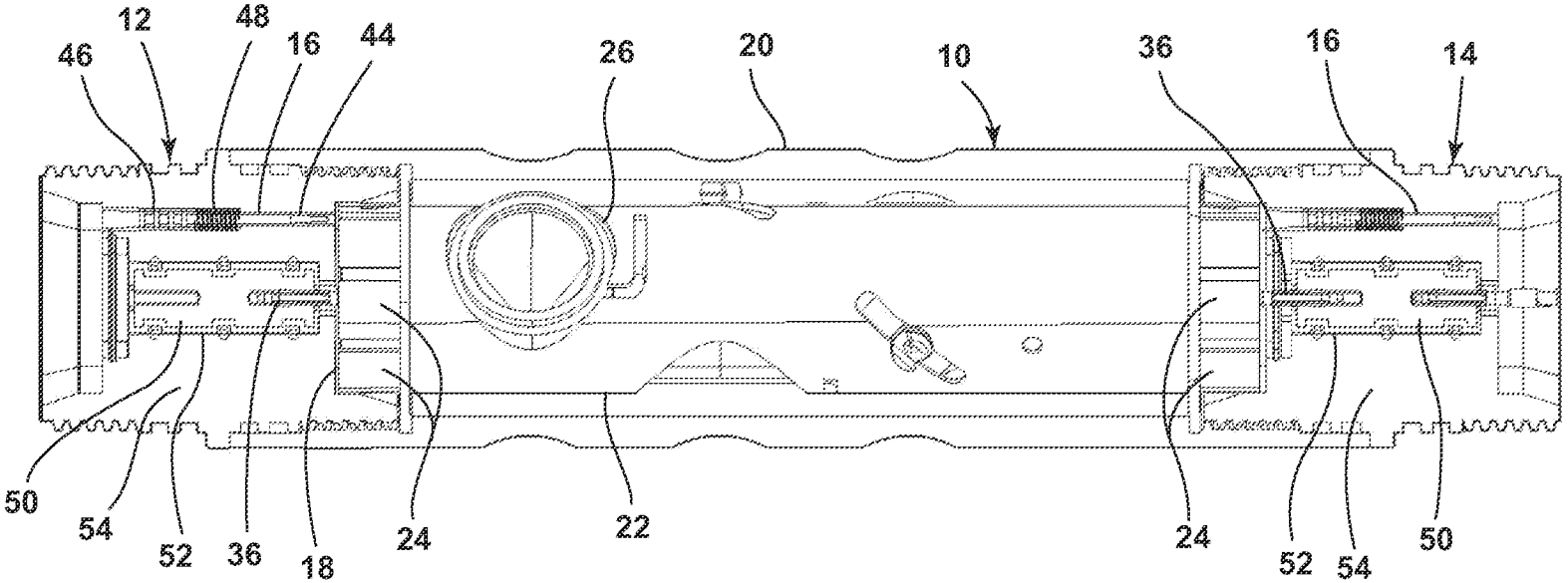
FIG. 1 is a cross-sectional view of a perforating gun joined to two arming tandems in accordance with one embodiment (the left tandem being the up-string tandem).

A section of a gun string in accordance with an exemplary embodiment is illustrated in FIG. 1. The section of a gun string includes a perforating gun 10 joined to first and second arming tandems 12, 14. Each arming tandem 12, 14 includes an internal spring-biased arming pin 16. Detonating the last perforating gun in the gun string moves the arming pin 16 in the adjacent arming tandem into contact with a grounding plate 18 in the next perforating gun, thereby creating an electrical connection to ground to electrically connect the next perforating gun in the gun string.

As more specifically shown in FIG. 1, the perforating gun 10 includes an outer gun barrel 20 and an internal shaped charge positioning tube 22. The outer gun barrel 20 includes opposing box ends, and the first and second arming tandems 12, 14 are threaded to the respective box ends of the outer gun barrel 20 so that two or more perforating guns can be joined in series in a gun string. The outer gun barrel 20 is cylindrical and includes a length that is greater than the length of the shaped charge positioning tube 22, such that the outer gun barrel 20 extends beyond the shaped charge positioning tube 22.

The shaped charge positioning tube 22 is formed from an electrically conductive material, for example steel, further optionally stainless steel or carbon steel. Each end portion of the shaped charge positioning tube 22 defines a plurality of longitudinal slots, such that the shaped charge positioning tube 22 includes castellated or segmented end portions 24. The shaped charge positioning tube 22 also includes a cylindrical body having multiple shaped charge openings 26 that receive a corresponding number of shaped charges. The openings 26 are angularly offset from each other in the current embodiment, but can be in angular alignment in other embodiments.

Figure 2:
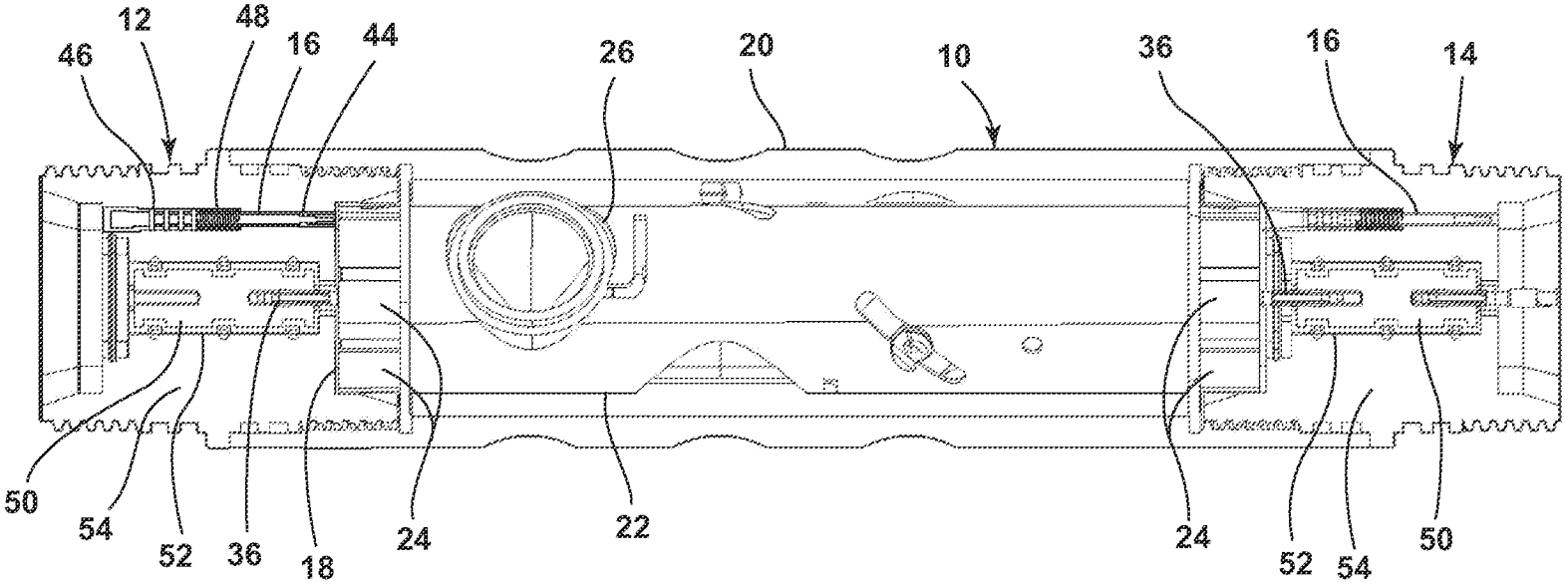
FIG. 2 illustrates the up-string tandem as being armed by contact of an arming pin with a grounding plate.
Figure 3:
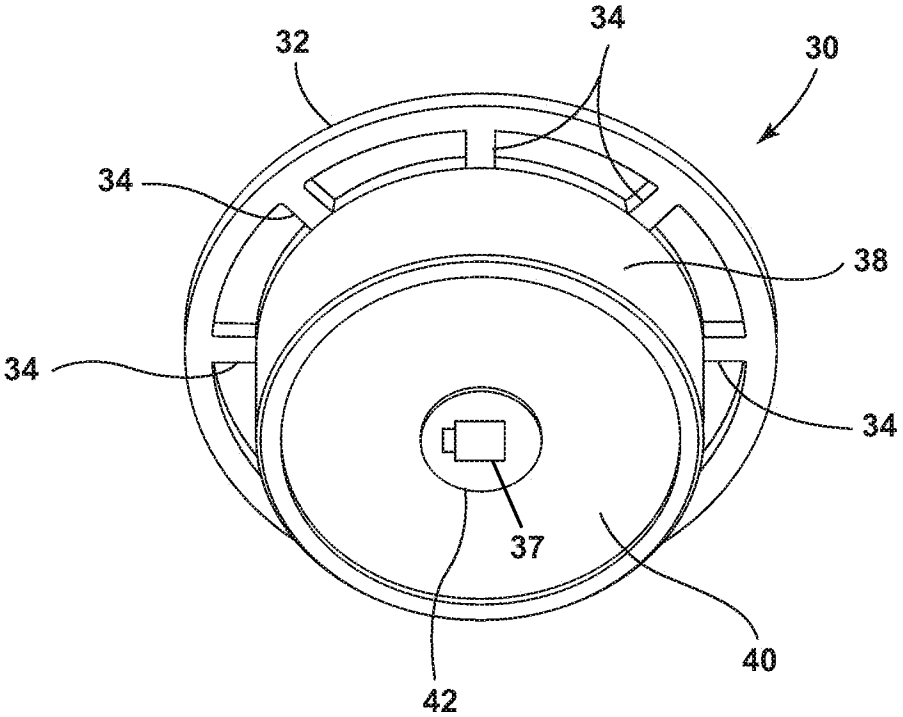
FIG. 3 is a perspective view of a bulkhead assembly including a grounding plate for engaging an arming pin contained within an arming tandem.

A bulkhead 30 is positioned at each end of the shaped charge positioning tube 22 and is separately shown in FIG. 3. Each bulkhead 30 is formed from an electrically insulating material, for example molded plastic. Each bulkhead 30 also includes a ring 32 supported by a plurality of radial spokes 34. A contact pin 36 (shown in FIG. 1) extends from the bulkhead 30 for receiving a firing signal from (or transferring a firing signal to) an adjacent arming tandem. The contact pin 36 includes an outwardly bowed middle portion with multiple deformable arms that compress radially inward when received within a socket opening in a tandem. Each bulkhead 30 also includes a cylindrical body 38 that is shaped to be received within the open end of the shaped charge positioning tube 22 by interference fit. The contact pin 36 (visible in FIGS. 1-2) protrudes from a central opening 37 (visible in FIG. 3) in the cylindrical body 38.

The up-hole bulkhead 30 includes a grounding plate 40 that is electrically isolated from the contact pin 36 by an electrically insulating sleeve 42. The grounding plate 40 is formed from an electrically conductive material and is disk-shaped. The grounding plate 40 provides a bearing surface for the arming pin 16 contained within the adjacent arming tandem. Each arming pin 16 is received within a counterbored opening having a small diameter portion 44 and a large diameter portion 46 joined by an annular shelf. A compression spring 48 is seated against the shelf and biases the arming pin 16 away from the grounding plate 40.

The first arming tandem 12 also includes a first pass-through element 50 and the second tandem 16 includes a second pass-through element 50. Each pass-through element 50 is surrounded by an insulating sleeve 52. The insulating sleeve 52 is formed from a non-conductive material to electrically isolate the pass-through element 50 from the tandem body 54, which is formed from a non-conductive material or is electrically grounded. At least one O-ring surrounds the insulating sleeve 52 to create a seal with the tandem body 54.

The present embodiment enables the sequential arming of a series of perforating guns in a gun string, optionally without the need for an addressable switch in each such perforating gun. In operation, a firing signal is received at the first perforating gun in the gun string, causing the shaped charges within that perforating gun to detonate, thereby creating a plurality of perforations through the wellbore casing. Pressure from this detonation moves the arming pin 16 in the immediately adjacent arming tandem into contact with the grounding plate 40 in the next perforating gun, as shown in FIG. 2, overcoming the biasing force of the compression spring 48. As a result, the next perforating gun is electrically connected to the gun string, and a premature detonation of any down-hole perforating guns in the gun string is prevented.

Though not shown, the gun string can include diodes inline to control polarity, thereby preventing a stray voltage from causing a cascade event. Each perforating gun in the gun string would include a diode with the opposite polarity of the adjacent perforating gun(s). In this configuration, each perforating gun in the gun string is detonated with a firing signal having an alternating positive or negative voltage. This configuration guards against the accidental detonation of the next perforating gun in the gun string due to the large capacitance on the wireline cable, which could otherwise fire the next detonator in the gun string.

Figure 4B:
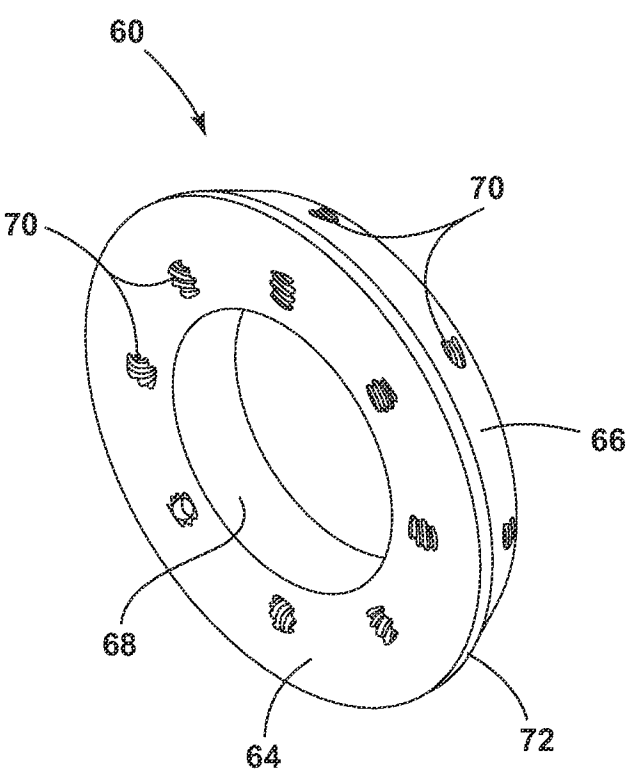
FIG. 4A and FIG. 4B include perspective views of a locking collar for use with a perforating gun string in accordance with another embodiment.
Figure 4A:
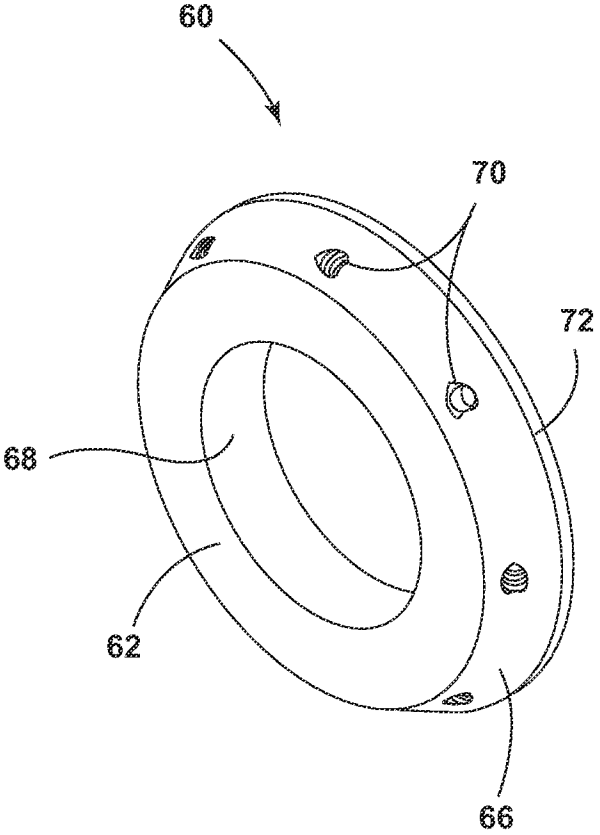
Figure 5:
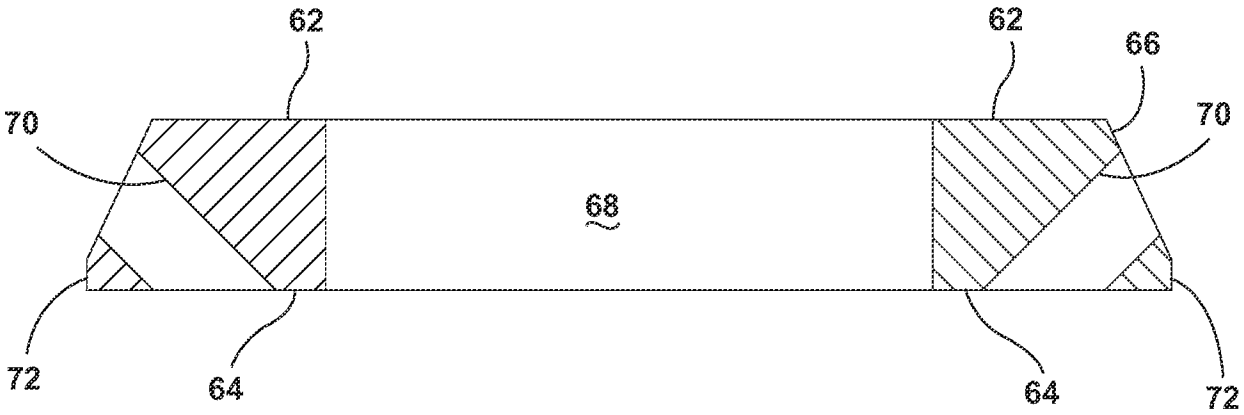
FIG. 5 is a cross-sectional view of a locking collar of FIG. 4A and FIG. 4B.

In another embodiment as shown in FIGS. 4A and 4B, a locking collar is provided. The locking collar is generally designated 60 and is used to secure a perforating gun so that the shaped charges are locked into a set firing position. As shown in FIGS. 4A and 4B, the locking collar 60 is ring-shaped and includes opposing end surfaces 62, 64 that are joined by a frustoconical outer sidewall 66 and a cylindrical inner sidewall 68. The outer sidewall 66 is sloped along a major section of its length and includes a plurality of threaded openings 70 that extend at an angle toward the second end surface 64, which includes a larger outer diameter than the first end surface 62. Eight threaded openings 70 are shown in the illustrated embodiment, but greater or fewer threaded openings can be used in other embodiments. As shown in FIG. 5, each threaded opening 70 extends entirely through the locking collar 60 and intersects the second end surface 64 at an angle of approximately 30-degrees to 60-degrees, inclusive, further optionally 45-degrees. The inner sidewall 68 runs parallel to a truncated lip 72 of the outer sidewall 66, which then angles inward toward the first end surface 62.

Figure 6:
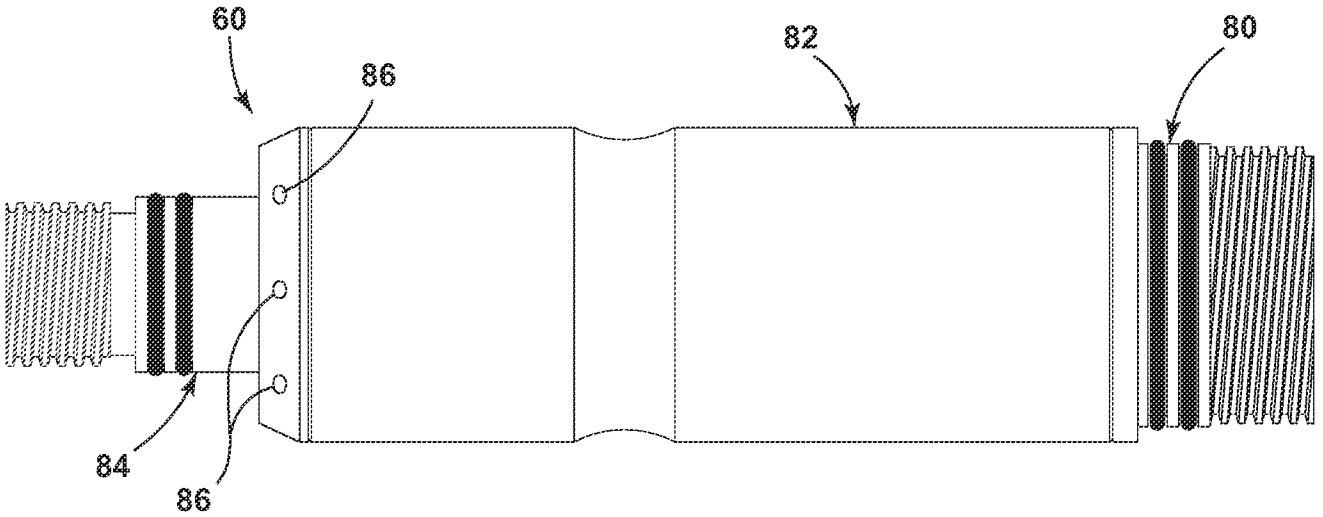
FIG. 6 is side view of a perforating gun assembly including the locking collar of FIG. 4A and FIG. 4B.

As noted above, the locking collar 60 is used to secure a perforating gun so that the shaped charges are locked into a set firing position. As shown in FIG. 6, for example, a section of a gun string includes a tandem 80, a perforating gun 82, a locking collar 60, and a top sub 84. The tandem 80 is used to connect two perforating guns together and can comprise the arming tandem discussed above in connection with FIG. 1. The perforating gun 82 includes multiple shaped charge openings that are angularly offset from each other for creating a desired pattern of perforations in a wellbore casing. The top sub 84 is threadably joined to the perforating gun 82, opposite of the tandem 80, and is used to connect to various accessories, for example a weight bar or a separation tool. The locking collar 60 extends around the top sub 84 and receives set screws 86 within the threaded openings 70. The set screws 86 are externally threaded and headless and engage an end portion of the perforating gun 82 to radially align the gun ports of the perforating gun 82.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A perforating gun assembly comprising:

a perforating gun including an outer gun barrel, an internal shaped charge positioning tube, and a bulkhead joined to an end portion of the shaped charge positioning tube, the bulkhead including a contact pin and a grounding plate; and an arming tandem that is joined to the perforating gun, the arming tandem including:

a threaded outer body including a central through-bore interconnecting first and second female openings of the threaded outer body, a pass-through element within the central through-bore of the threaded outer body, the pass-through element being electrically conductive and being surrounded by an insulating sleeve, and an arming pin that is laterally offset from the pass-through element, the arming pin being biased away from the grounding plate by a compression spring.

2. The perforating gun assembly of claim 1, wherein the grounding plate is electrically conductive and is disk shaped.

3. The perforating gun assembly of claim 1, wherein the contact pin and the grounding plate are electrically isolated from each other.

4. The perforating gun assembly of claim 1, wherein the arming pin is electrically conductive and is housed in a counterbored opening in the tandem.

5. The perforating gun assembly of claim 4, wherein the counterbored opening includes a small diameter portion and a large diameter portion separated by an annular shelf, the annular shelf comprising a spring seat for the compression spring.

6. An arming tandem comprising:

a threaded outer body including first and second female openings, the threaded outer body including a central through-bore interconnecting the first and second female openings;

an insulating sleeve contained within the central through-bore, the insulating sleeve defining a longitudinal opening therethrough;

a pass-through element within the longitudinal opening of the insulating sleeve, the pass-through element being electrically conductive; and an arming pin within a counterbored opening that is laterally offset from the pass-through element, the arming pin being biased in a retracted position.

7. The arming tandem of claim 6, further including a helical compression spring within the counterbored opening for biasing the arming pin in the retracted position.

8. The arming tandem of claim 6, wherein the arming pin is electrically grounded for engaging a grounding plate of an adjacent perforating gun.

9. The arming tandem of claim 6, wherein the first and second female openings include a sloped sidewall.

10. The arming tandem of claim 6, wherein the pass-through element includes a first socket opening at a first end thereof and a second socket opening at a second end thereof.

11. A perforating gun assembly comprising:

an arming tandem comprising:

a threaded outer body including a central through-bore interconnecting first and second female openings of the threaded outer body, a pass-through element within the central through-bore of the threaded outer body, the pass-through element being electrically conductive and being surrounded by an insulating sleeve, and an arming pin that is laterally offset from the pass-through element, the arming pin being biased away from the grounding plate by a compression spring; and a perforating gun joined to the arming tandem and including a bulkhead, the bulkhead comprising:

a cylindrical body, a plurality of radial spokes coupled to an outer ring, a contact pin protruding from a central opening in the cylindrical body, and a grounding plate surrounding the central opening and being electrically isolated from the contact pin.

12. The perforating gun assembly of claim 11, wherein the cylindrical body is formed from a non-conductive material.

13. The perforating gun assembly of claim 11, wherein the grounding plate includes a flat surface for contacting the arming pin from the arming tandem.

14. The perforating gun assembly of claim 11, wherein the plurality of radial spokes and the outer ring are axially offset from the grounding plate.

* * * * *